United States Patent [19]

Krebs

[11] 4,007,727

[45] Feb. 15, 1977

[54] OVEN DOOR WINDOWS

[75] Inventor: Jacob Krebs, St. Clair Shores, Mich.

[73] Assignee: Shatterproof Glass Corporation, Detroit, Mich.

[22] Filed: Aug. 6, 1975

[21] Appl. No.: 602,241

[52] U.S. Cl. ..... 126/200

[51] Int. Cl.[2] ..... F23M 7/04

[58] Field of Search ..... 126/198, 200; 52/304, 52/616

[56] References Cited

UNITED STATES PATENTS

| | | | |
|---|---|---|---|
| 2,325,773 | 8/1943 | Hennessy | 126/200 |
| 2,587,527 | 2/1952 | Reeves | 126/200 |
| 2,728,116 | 12/1955 | Westlund | 52/616 |
| 3,339,541 | 9/1967 | Evans | 126/200 |
| 3,760,792 | 9/1973 | White | 126/200 |
| 3,837,129 | 9/1974 | Losell | 52/616 |

*Primary Examiner*—John J. Camby
*Assistant Examiner*—Larry I. Schwartz
*Attorney, Agent, or Firm*—William E. Nobbe

[57] ABSTRACT

An oven door comprising front and back metal door panels having a substantially rectangular central opening therein to receive a window unit for see-through into the oven compartment. The window unit comprises a substantially rectangular metal frame formed with spaced channel portions connected by an integral spacer portion, the spacer portions at the top and bottom of the frame being provided with aligned slots, and three spaced, parallel glass panels, the inner and outer glass panels being mounted in the channel portions of the frame and the center glass panel being inserted through the slots in the spacer portion. The center glass panel is supported at its lower edge and projects upwardly beyond the spacer portion at the top of the frame into the space between the front and back metal door panels.

6 Claims, 4 Drawing Figures

OVEN DOOR WINDOWS

BACKGROUND OF THE INVENTION

This invention relates to an oven door of the type incorporating a window means for viewing the oven interior when the door is closed to observe the advance of the cooking process.

The oven door usually comprises a body portion including front and back metal panels having a substantially rectangular central opening therein in which the window means is mounted. It has heretofore been common practice to provide a window means comprising a double-glazed glass unit including two spaced, parallel, transparent glass panels, with a substantially dead air space therebetween. Although double-glazed window units of this character were designed to prevent transmission of oven heat, they did not function satisfactorily to maintain the outer exposed glass panel at the desired low temperature, particularly after the oven had been on for some period of time. To overcome this objection, a thin transparent reflective metal coating has been applied to the inner surface of the outer glass panel to reduce the transmittance of oven heat through the window. While these coatings have materially reduced the problem of excessive window temperature, they have not proven wholly successful in meeting the increasingly stringent standards required of the industry for lower window temperatures.

Another problem encountered with this type of oven door has been the relatively high temperature attained by the front metal door panel, particularly in the area above the window.

The present invention contemplates the provision of a multiple-glazed oven window unit which will effectively reduce the temperature not only of the outer exposed glass panel but also of the oven door proper and particularly that portion of the front metal door panel above the window.

DESCRIPTION OF THE PREFERRED EMBODIMENT

Figure 1:
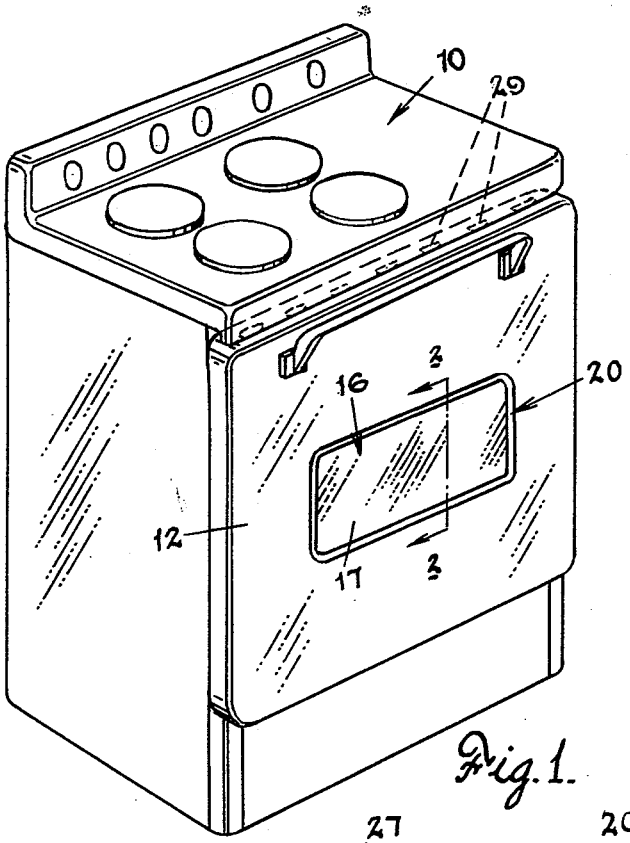
FIG. 1 is a perspective view of a domestic range employing a windowed oven door constructed in accordance with the invention.
Figure 2:
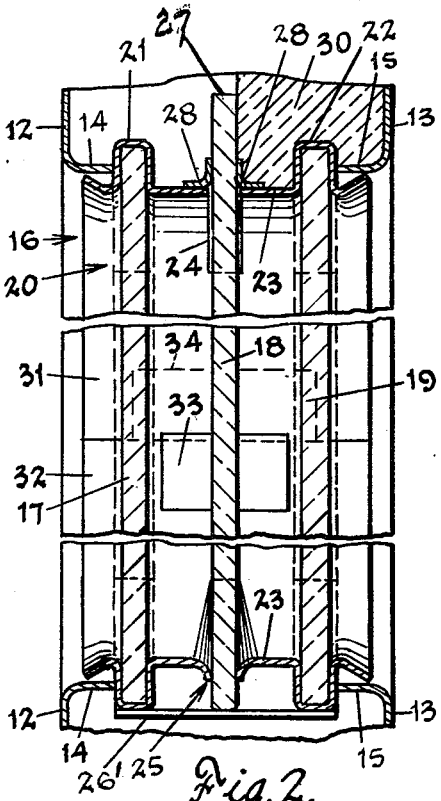
FIG. 2 is a vertical transverse section of the window unit taken substantially on line 2—2 of FIG. 1.

Referring to the drawings, there is illustrated in FIG. 1, a floor standing range 10 employing an oven door 11 constructed in accordance with the present invention. As shown in FIG. 2, the oven door comprises front and back metal door panels 12 and 13 which are provided with aligned substantially rectangular openings therein defined by inwardly turned flanges 14 and 15 respectively and adapted to receive therein the novel window unit 16 of this invention.

In order for an oven range to be acceptable for domestic use, it is required that the outer surface of the outer glass panel of the window not exceed a specified temperature, the purpose being, of course, to prevent persons and especially children, from being burned should they accidently come in contact with the panel. The requirements as to maximum permissible surface temperature are becoming increasingly stringent, presenting a serious problem for the range manufacturer. It is therefore a primary purpose of this invention to effect reduction of the temperature of the outer glass panel to an acceptable level during normal operation of the oven while, at the same time, providing for easy viewing of the oven interior without opening the door.

The window unit 16 is of the multiple-glazed type including three spaced, parallel transparent panels 17, 18 and 19, preferably of tempered glass. The panels are mounted in a common frame 20 made of a relatively light weight metal. The frame is formed with spaced channel portions 21 and 22 extending around all four sides of the frame and connected by an integral flat web or spacer portion 23. The inner and outer glass panels 17 and 19 are received in the channel portions 21 and 22 respectively and fixedly mounted therein, while the center glass panel 18 is carried by the spacer portion 23.

More particularly, the spacer portion 23 is provided at the top and bottom of the frame with aligned slots 24 and 25 respectively through which the center glass panel 18 is loosely inserted, said panel extending below the slot 25, as indicated at 26, and supported at its lower edge on transverse straps 26′ suitably secured, as by spot welding, to the bottoms of the channel portions 21 and 22.

Figure 3:
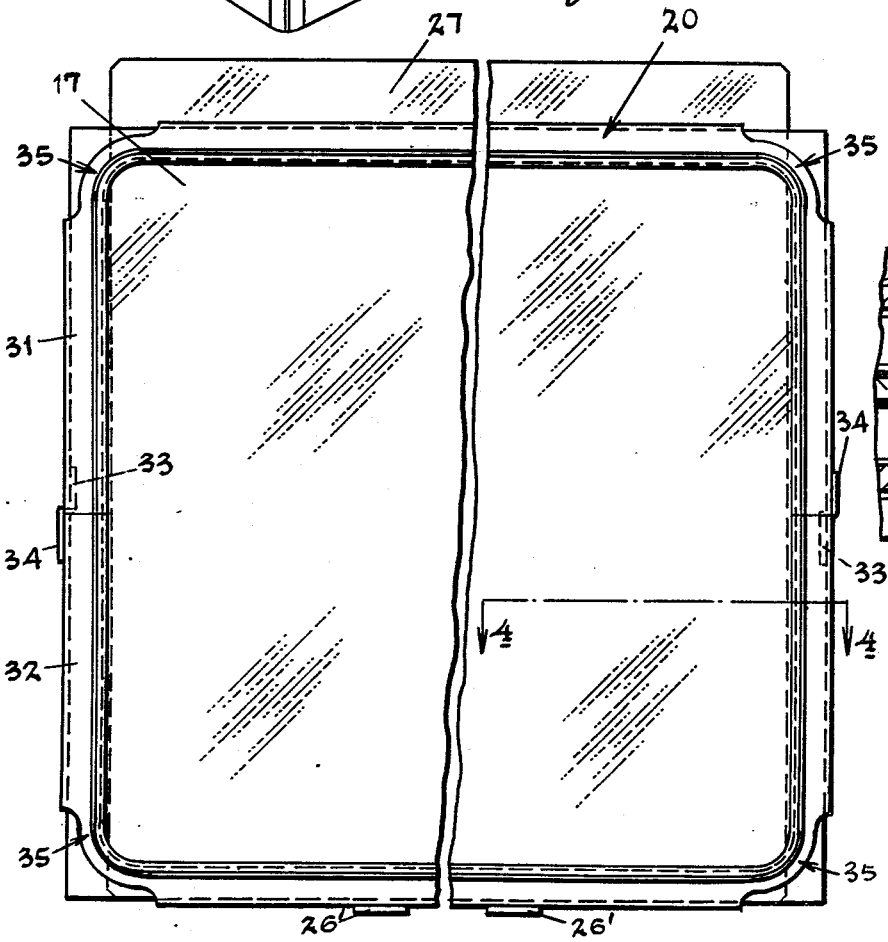
FIG. 3 is a front view of the window unit.
Figure 4:
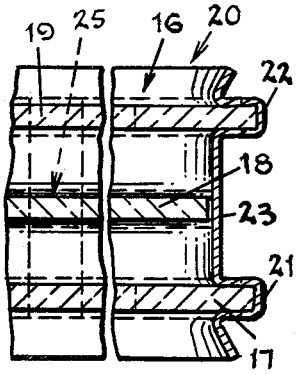
FIG. 4 is a horizontal section taken substantially on line 4—4 of FIG. 3.

The width of the center glass panel 18 is substantially equal to the distance between the spacer portions of the metal frame at the opposite sides thereof, as shown in FIG. 4. On the other hand, the vertical dimension of the center glass panel is at least equal to the vertical dimension of the inner and outer glass panels 17 and 19; however, the center panel may project upwardly beyond the inner and outer panels to provide a so-called fin 27 (FIGS. 2 and 3), which is received in the space between the front and back metal door panels. The distance the fin 27 projects upwardly beyond the front and rear panels may be varied depending upon the size and/or design of the oven door and the results to be obtained.

While the center glass panel 18 is loosely received in the slots 24 and 25 in the spacer portions 23 at the top and bottom of the frame, there is a relatively close fit so that leakage of air or entry of dirt and dust into the spaces between the glass panels will be minimal. However, to further insure against the entry of dirt and dust, aluminum adhesive tape 28 may be used, if found desirable, to seal the slot 24 in the spacer portion 23 at the top of the metal frame.

By extending the center glass panel through the slots 24 and 25 in the spacer portions 23 at the top and bottom of the frame, the passage or conduction of oven heat through the metal spacer portions to the outer glass panel 17 will be interrupted or broken, with the result that the outer glass panel will be maintained cooler than would otherwise be the case. In other words, the slots 24 and 25 serve as a thermal break.

The projecting portions 26 and 27 at the top and bottom of the center glass panel 18 will also function to disperse some of the oven heat from said panel into the space between the front and back metal door panels. This heat can then be effectively dissipated to the ambient atmosphere by providing the oven door, at the top and bottom thereof, with openings 29. The space between the center glass panel 18 and the back wall 13 of the oven door, above the window unit, is preferably filled with a suitable insulating material 30, such as fiber glass.

If desired, the inner surface of the outer glass panel can be provided with a thin, reflective metal coating, such as gold or chromium, to further reduce the amount of oven heat reaching the outer glass panel.

The metal frame 20 can be formed of two substantially U-shaped sections 31 and 32 which are joined together at opposite sides of the frame, as indicated at 33 and 34 in FIG. 3. The channel portions 21 and 22 of the frame are also cut away at the four corners thereof, as indicated at 35, to permit the use of substantially rectangular inner and outer glass panels.

It is to be understood that the present disclosure has been made only by way of example and that modifications and changes may be resorted to without departing from the spirit and scope of the invention as hereinafter claimed.

I claim:

1. An oven door, comprising a body portion having front and back metal door panels provided with a substantially rectangular opening therein, a window unit mounted in said opening including a substantially rectangular frame formed with spaced channel portions connected by an integral spacer portion, said spacer portion at the top and bottom of the frame being provided with aligned slots, three spaced, parallel glass panels, the inner and outer glass panels being fixedly mounted in said channel portions of the frame and the center glass panel being loosely inserted through the aligned slots in said spacer portion, and means for supporting said center glass panel in said slots.

2. The oven door of claim 1, including means carried by the channel portions at the bottom of the frame for supporting the center glass panel at the bottom edge thereof.

3. The oven door of claim 1, in which the center panel projects at the top and bottom thereof beyond the respective spacer portion into the space between the front and back metal door panels.

4. The oven door of claim 3, including insulating material disposed in the space between the center glass panel and back metal door panel above the window unit.

5. The oven door of claim 3, in which the body portion of the door is provided with openings at the top and bottom thereof communicating with the space between the front and back metal door panels.

6. The oven door of claim 1, including means carried by the frame for supporting the center glass panel at the bottom edge thereof.

* * * * *